US011027805B1

(12) United States Patent
Rush, III

(10) Patent No.: US 11,027,805 B1
(45) Date of Patent: Jun. 8, 2021

(54) SYSTEMS AND METHODS FOR LAUNCHING AND RECOVERING OBJECTS IN AQUATIC ENVIRONMENTS; PLATFORMS FOR AQUATIC LAUNCH AND RECOVERY

(71) Applicant: OceanGate, Inc., Everett, WA (US)

(72) Inventor: Richard Stockton Rush, III, Seattle, WA (US)

(73) Assignee: OceanGate, Inc., Everett, WA (US)

( * ) Notice: Subject to any disclaimer, the term of this patent is extended or adjusted under 35 U.S.C. 154(b) by 150 days.

(21) Appl. No.: 16/359,844

(22) Filed: Mar. 20, 2019

Related U.S. Application Data

(63) Continuation-in-part of application No. 15/201,226, filed on Jul. 1, 2016, now Pat. No. 10,259,540, which is a continuation-in-part of application No. 14/454,663, filed on Aug. 7, 2014, now Pat. No. 9,381,980.

(60) Provisional application No. 61/863,848, filed on Aug. 8, 2013.

(51) Int. Cl.

| | |
|---|---|
| ***B63B 35/00*** | (2020.01) |
| ***B63G 8/00*** | (2006.01) |
| ***B63B 25/28*** | (2006.01) |
| ***B63G 8/42*** | (2006.01) |

(52) U.S. Cl.
CPC ..... *B63G 8/001* (2013.01); *B63B 25/28* (2013.01); *B63G 8/42* (2013.01); *B63B 2025/285* (2013.01); *B63G 2008/425* (2013.01)

(58) Field of Classification Search
CPC ..... B63G 8/001; B63G 2008/008
See application file for complete search history.

(56) References Cited

U.S. PATENT DOCUMENTS

| | | | | |
|---|---|---|---|---|
| 3,625,171 | A * | 12/1971 | Bailey | B63G 8/41 114/314 |
| 3,818,523 | A * | 6/1974 | Stillman, Jr. | B63B 22/18 441/22 |
| 3,857,351 | A * | 12/1974 | Wynn, Jr. | B63G 8/41 114/322 |
| 4,266,500 | A * | 5/1981 | Jurca | B63B 22/20 114/333 |
| 4,753,552 | A * | 6/1988 | Karal | B63C 11/36 405/189 |
| 5,129,348 | A * | 7/1992 | Rannenberg | B63G 8/24 114/312 |
| 6,575,105 | B1 * | 6/2003 | Zingale | B63C 7/08 114/333 |

(Continued)

FOREIGN PATENT DOCUMENTS

| | | | | |
|---|---|---|---|---|
| EP | 2567865 | A2 * | 3/2013 | B63B 25/28 |

*Primary Examiner* — Benjamin F Fiorello
(74) *Attorney, Agent, or Firm* — DWC Law Firm, P.S.

(57) ABSTRACT

Systems and methods for launching and retrieving payloads in aquatic environments employ a platform that is both floatable and submersible at the discretion of and/or under the control of a user, on which submersible objects to be launched, delivered to a subsea location and/or retrieved (the payload) may be located. The submergible platform has a plurality of sealed and/or sealable buoyancy chambers and at least one low pressure gas storage tank having associated fixtures and valves providing introduction of gas to the buoyancy chambers. A payload docking system providing secure docking of a payload on the platform deck is also disclosed.

4 Claims, 7 Drawing Sheets

(56) References Cited

U.S. PATENT DOCUMENTS

| | | | | |
|---|---|---|---|---|
| 7,255,054 | B1 * | 8/2007 | DiGregorio | B63G 8/001 114/256 |
| 2015/0251739 | A1 * | 9/2015 | Ryuh | B25J 11/00 114/338 |
| 2018/0057128 | A1 * | 3/2018 | Dowling | B63G 8/18 |

* cited by examiner

SYSTEMS AND METHODS FOR LAUNCHING AND RECOVERING OBJECTS IN AQUATIC ENVIRONMENTS; PLATFORMS FOR AQUATIC LAUNCH AND RECOVERY

REFERENCE TO RELATED PATENT APPLICATIONS

This application is a continuation-in-part of U.S. patent application Ser. No. 15/201,226, filed Jul. 1, 2016, which is a continuation-in-part of U.S. patent application Ser. No. 14/454,663, filed Aug. 7, 2014, issued as U.S. Pat. No. 9,381,980 on Jul. 5, 2016, which claims the benefit of U.S. Patent Application No. 61/863,848, filed Aug. 8, 2013. The disclosures of the listed patent applications are incorporated herein by reference in their entireties.

TECHNICAL FIELD OF THE DISCLOSURE

The present disclosure relates to systems and methods for launching and recovering objects in aquatic environments, and to submersible platforms for accomplishing aquatic launches and recoveries. The disclosure relates, more particularly, to methods and systems for deploying and recovering payloads such as submersible vehicles, equipment, and the like, used for subsea operations. More particularly yet, this disclosure relates to methods and systems that permit payloads to be safely and conveniently launched and recovered in rough sea conditions and in diverse geographical locations without the need for personnel to be in the water and without the need for dedicated ships, cranes or other specialized, ship-dependent hardware, active platform buoyancy or other active depth control systems.

BACKGROUND

In marine operations involving subsea work, it's often necessary to deploy a structure, vehicle or piece of equipment in different aquatic locations, sometimes far from land and terrestrial support systems. Traditional deployment methods use various types of assist vessels having heavy cranes, heave compensation systems, reinforced cages/protective systems, "A" frames, moon pools and lowering decks. The structure being deployed is typically mechanically coupled (directly or indirectly) to the vessel deploying it, as the load is lowered into and recovered from the water. The traditional deployment and recovery systems attempt to resolve the fundamental problem of matching, or minimizing, the relative motion of two spatially separate but mechanically linked masses in a dynamic environment such as at the sea surface. Entry of the load into and exit of the load from a turbulent "splash zone" at and near the water surface can be treacherous and may damage the load or the launch/recovery vessel, and may as well produce unsafe conditions for personnel and equipment in the area.

In one exemplary launch and recovery system disclosed in PCT International Patent Publication WO 2013/072690, a subsea payload is lifted from and deployed to an undersea location using a lift line supported by a heave-compensating winch on a surface vessel. Movement of a submersible launch unit is controlled by means of on-board thrusters. Vessel and crew time are expensive, and the expense incurred as a result of launch and recovery vessel and crew requirements may limit the frequency of launch and recovery operations, particularly in remote locations.

One system that avoids mechanically joining heavy dissimilar objects (such as a launch vessel and a submersible vessel or payload) at the splash zone places the vehicle or payload on a "sinking barge" and tows the barge/payload to a dive location, where both the barge and the payload are sunk, as a unit, under controlled conditions, generally using an active depth control system. The payload/vehicle is deployed by releasing it from the barge transport component at a desired depth where the sea conditions are steady and manageable. The few existing systems that use this type of subsurface launch and recovery approach require the use of an active manually operated depth control system, and they generally require the use of divers to detach the vehicle from the barge during deployment and to re-attach the vehicle during recovery. Personnel are also generally required to operate the active depth control system during launch and recovery.

A submersible launch, recovery and transport vehicle (LRT) of the aforementioned type was developed for transporting and deploying research submarines in rough waters in connection with the Hawaii Undersea Research Laboratory (HURL). The LRT is a twin-hulled, submersible platform upon which a submarine may be positioned and secured. It is towed on the surface by a support vessel to a desired dive site, and the LRT and submarine are both submerged, under the control of a diver pilot, to maintain a stable hover at a depth of 50-60 feet. The submarine is released from the platform by diver(s), and the LRT maintains at hover awaiting return of the submarine or returns to the surface. Tanks having high-pressure air (e.g., 3000 psi) are used in the active buoyancy system, which submerges and raises the platform, and also maintains the platform at a desired depth. The use of high-pressure air and tanks requires the use of high-pressure fittings and results in long tank fill and evacuation times, increasing the cost and complexity of the system. While this system allows subsea launch and recovery of submersible vehicles from a subsea location that is isolated from surface conditions (waves, etc.), it requires significant assistance in terms of personnel, and any failure of the active depth control system may result in damage to, or loss of the LRT or its payload.

Systems for submerging work platforms and for supporting submerged work platforms during underwater activities are also known. In one system disclosed in U.S. Pat. No. 5,507,596, a support system for supporting a submerged work platform using one or more vessels uses a plurality of cables connected between the surface support vessel(s) and the underwater platform. Several individually controlled cables are used to provide a desired number of degrees of freedom of control vis a vis the work platform. The surface vessel(s) (e.g., ship(s) or barge(s)) are subject to surface sea motions, and the motions of the support structure(s) are sensed and the length of the cables is actively adjusted to maintain the work platform stationary, even as the support vessel(s) move at the sea surface.

Notwithstanding the existence of various launch and recovery systems, and of various schemes for supporting underwater platforms, there remains a need for a simple vessel and payload launch and recovery system that permits the safe deployment and recovery of equipment and vessels in heavy sea conditions, and that does not require substantial vessel or personnel support or active depth control systems.

SUMMARY

In one aspect, systems for launching and retrieving objects in aquatic environments, as disclosed herein, comprise a platform that is both floatable and submersible at the discretion of and/or under the control of a user, and on which objects to be launched and/or recovered (referred to as the "payload") may be located and stably docked. The system typically comprises a variable buoyancy, submersible platform that may be towed or shipped or otherwise maneuvered (e.g., propelled under its own power) to a desired site for submersion and launch or delivery of the payload. In one embodiment, the submersible platform comprises a deck, a plurality of sealed and/or sealable chambers provided beneath the deck, and at least one low pressure gas storage tank having associated fixtures and valves that provide introduction of gas (e.g., air) into one or more of the sealable chambers under control of a user. In some embodiments, a plurality of gas storage tanks having associated fixtures and valves providing introduction of gas into one or more buoyancy chambers are provided.

In some embodiments, the buoyancy system comprises a plurality of low pressure gas storage tanks used for storing gas (e.g., air) at a pressure of less than about 300 psi, and in some embodiments at a pressure of less than about 200 psi. The use of low pressure storage tanks and low pressure gas in the buoyancy system allows utilization of relatively large, lightweight, positively buoyant storage tanks, and it also allows for the use of large diameter, low pressure fittings, hoses, valves, and the like, which reduces the complexity and cost of the system. The use of low pressure storage tanks and low pressure gas moreover provides rapid tank filling and evacuation, and thus provides more rapid platform launch and recovery operations.

In general, one or more low pressure gas storage tanks is provided in gas-flow communication with at least one sealable buoyancy chamber, with remote valve actuation providing controlled gas flow to the at least one sealable platform chamber under control of an operator. In some embodiments, multiple discrete sets of low pressure gas storage tanks are provided in gas-flow communication with multiple sealable platform buoyancy chambers. In some embodiments, one or more higher pressure gas storage tanks may feed into one or more low pressure gas storage tanks.

In some embodiments, at least some of the sealable buoyancy chambers are positioned below a platform deck. In some embodiments, at least some of the low pressure gas storage tanks are located at or above the level of the platform deck and/or at or above the center of mass of the platform. In some embodiments, at least one sealable buoyancy chamber is located aft of a platform center of mass and at least one sealable buoyancy chamber is located forward of a platform center of mass. In some embodiments, at least one sealable buoyancy chamber is located to port of the center of mass of the platform and at least one sealable buoyancy chamber is located to starboard of the center of mass of the platform. In some embodiments, at least four sealable buoyancy chambers are provided, and each of the four sealable chambers is located substantially in a different quadrant of the platform, and substantially underneath the deck of the platform. In some embodiments, each of four sealable chambers has an L-configuration.

In operation, a platform as described above may be maintained in a floating condition when at least one sealable buoyancy chamber (and, in some embodiments, a plurality of sealable buoyancy chambers) is at least partially filled with gas (e.g., air). Introduction of water to and venting of air from one or more of the buoyancy chambers allows the floating platform (and any payload anchored on or associated with the platform) to submerge below the waterline to a desired depth under the control of an operator. Operation of valves and/or vents to introduce water to and evacuate gas from the chambers may be accomplished remotely (i.e., without requiring an operator located on the platform to manually adjust valves, vents, etc.). In some embodiments, the platform may be maintained at a desired depth using an active buoyancy maintenance system that periodically adjusts valves and vents to introduce water to and evacuate gas from buoyancy chambers to maintain a desired platform buoyancy at depth, and to maintain the platform in a stable condition at the desired depth. Alternatively, and advantageously, the platform may be maintained at a desired depth using a surface float system as described below without using an active buoyancy maintenance system that requires adjustment of platform buoyancy chambers to maintain platform stability at the desired depth.

Payload, which may include one or more objects such as a submersible vehicle, equipment, or the like, may be released from and securely docked to the platform when in a submerged condition. The platform and any payload docked to it may be raised to the sea surface by a buoyancy control system that evacuates water from the sealable buoyancy chamber(s) using controlled introduction of gas from the storage tanks to replace water in the buoyancy chambers to change and provide a desired level of platform buoyancy. Thus, the platform buoyancy system is desirably used under the control of an operator to submerge and raise the platform, while a surface float system may be used to maintain the platform at a desired depth.

In some embodiments, as mentioned, the system may additionally comprise a surface float system having one or more buoyant elements coupled to the submersible platform by means of one or more cable(s), line(s), chain(s) or other coupling mechanisms. The buoyant elements may be provided in the form of one or more floats, optionally providing selectable buoyancy. During an undersea deployment operation and following positioning of the platform at a desired deployment site, the platform is submerged under the control of a user (as described above) and the one or more floatable element(s) coupled to the platform by means of the coupling mechanism(s) remain at or in proximity to the sea surface.

In another embodiment, a buoyant element may be provided in the form of a ship or buoyant platform or the like, coupled to the submersible platform by means of one or more elastic or resilient element(s) such as spring(s), elastic or resilient cable(s), or the like. During an undersea deployment operation and following positioning of the platform at a desired deployment site, the platform is submerged under the control of a user and maintained at a desired depth by connection of the submerged platform to the buoyant element (e.g., ship) by means of elastic or resilient elements. In some embodiments, one or more resilient element(s) that are designed to provide a spring constant of less than 10% of the mass of the submerged platform divided by twice the average expected wave height. In general, this permits motion of the buoyant element located at the sea surface to couple only loosely to a submerged platform.

The platform has a relatively large mass and, when submerged, acts as a dampener, while the buoyant element(s) and associated line(s)/cable(s)/coupling mechanism(s) act, relative to the submerged platform, as classic spring. When the platform is submerged and the buoyant element(s) are separated from the platform and remain at or near the sea surface, the overall system acts as a classic spring mass dampener system. When the effective spring constant of the buoyant element(s) is low, the input force from displacement of the buoyant element(s) caused by wave motion is also small relative to the size and weight of the platform and its payload. The mass and dampening effect of the platform dominates the motion of the platform under these conditions and counteracts the spring/float (and surface sea) disturbances. By properly sizing the buoyant elements for observed and predicted wave periods and heights, the system can maintain a submerged platform at a desired depth in a stable and substantially still condition, largely unaffected by surface waves and without requiring an active platform buoyancy or other active depth maintenance control systems.

In another aspect, the present disclosure provides a payload docking and release system for securely docking and releasing a payload such as a submersible vehicle or equipment on a platform deck. In one embodiment, the payload has at least one (and in some embodiments multiple) docking rail(s) extending from the vehicle or equipment. The rail(s) is slidable in a mating channel system mounted on the platform deck. At least one end (and preferably both ends) of the docking rail(s) has a hook or detent or another mechanism securable in a mating fitting associated with the channel. In one embodiment, the payload may be moved to position the docking rail(s) in mating and suitably positioned channel(s) provided on the platform deck and the payload is advanced until a latching fitting mates with a complementary fitting provided on the channel. Additional positioning of the payload and additional securement features may be provided, as described in greater detail below.

BRIEF DESCRIPTION OF THE DRAWINGS

FIG. 8 shows payload rail(s) aligning on an aft (elevated) channel; FIG. 9 shows the payload and rail sliding forward and rocking down into a forward guide channel; FIG. 10 shows a forward latch member (e.g., hook) latching in a forward rail bracket to secure the rail and payload laterally and vertically at the forward end. FIG. 11 shows an aft portion of the rail and an aft latch member dropping down and seating in the channel; and FIG. 12 shows repositioning of the rail and payload to seat the aft latching members and secure the rail and payload laterally and vertically at the aft end. While the platform and payload docking configurations shown in FIGS. 8-12 may function as a stand-alone system, they are illustrated as one half of a platform and payload docking system in which a similar platform with associated docking elements is provided in a mirror image relationship to provide a platform having a width double that shown in FIGS. 8-12.

It will be understood that the appended drawings are not necessarily to scale, and that they present simplified, schematic views of many aspects of systems and components of the present invention. Specific design features, including dimensions, orientations, locations and configurations of various illustrated components may be modified, for example, for use in various intended applications and environments.

DETAILED DESCRIPTION OF EXEMPLARY EMBODIMENTS

Systems and methods for launching and recovering objects in aquatic environments and, particularly, for deploying payloads including submersible vehicles, equipment, systems, and the like underwater and recovering them from underwater locations are described in greater detail below, with reference to the appended figures. In general, a submersible platform may be provided in the form of a barge-like structure (or another platform structure) having a deck and a buoyancy control system in combination with buoyancy reservoir(s) sufficient to provide floatation of the platform and its payload, controlled submersion of the platform to a desired subsea depth, and recovery of the platform (with or without the payload) from a subsea location to the sea surface. The buoyancy control system may be controlled at the site of the submersible platform or, in some embodiments, from another vessel or location using remotely controllable systems.

Figure 1:
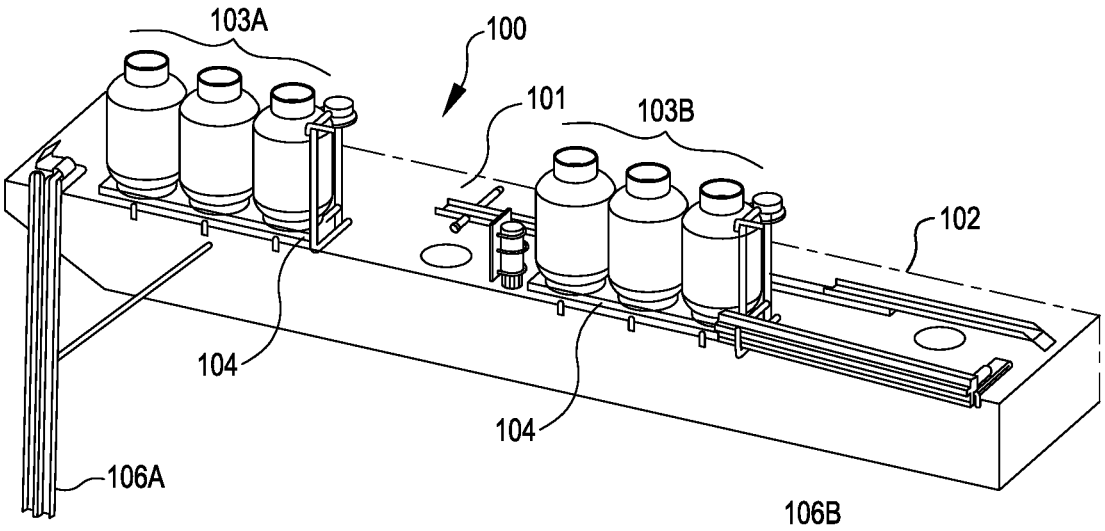
FIG. 1 shows a schematic drawing illustrating a platform having a deck and a plurality of gas storage tanks that communicate with sealable buoyancy chambers located underneath the deck.
Figure 2:
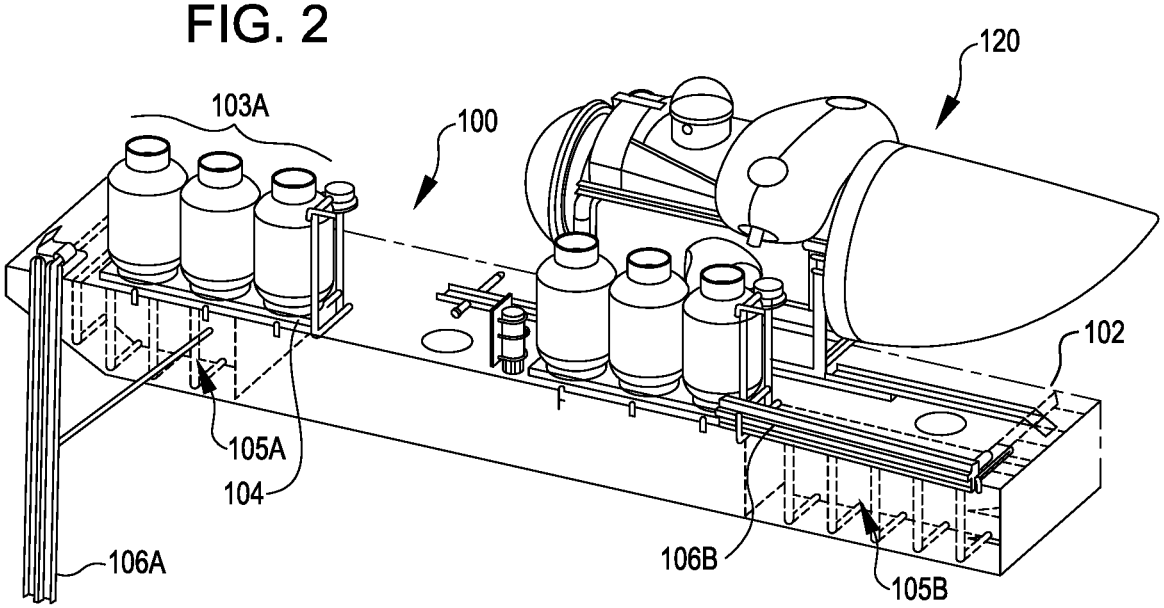
FIG. 2 shows a schematic drawing illustrating a platform similar to that shown in FIG. 1 with the outer platform walls partially removed to illustrate internal chambers and having a submersible vessel docked on the deck. While the images shown in FIGS. 1 and 2 depict platforms that may function as a stand-alone launch and recovery system, they represent one half of a platform, launch and recovery system as described herein. In these embodiments, another platform portion may be associated with the illustrated platform in a side-by-side, mirror image relationship along centerline 102 to provide a platform having a width double that shown in FIGS. 1 and 2.

One exemplary submersible platform embodiment is illustrated in FIGS. 1 and 2, in which platform 100 has a barge-like configuration and construction. Note that while the images shown in FIGS. 1 and 2 depict platforms that may function as a stand-alone launch and recovery system, they represent one longitudinal half of the platform, launch and recovery system as described in detail below. In the embodiment described, the platform comprises two platform portions similar or identical to platform 100 and its associated gas storage tanks, fittings, etc., as illustrated, configured in a side-by-side, longitudinal mirror-image relationship, with dashed line 102 representing a centerline. The platform may be fabricated as two or more sections joined together, or as a unitary platform.

Platform 100 is substantially enclosed and comprises a deck surface 101 and a plurality of sealed and/or sealable internal chambers. The internal construction of the barge-like platform structure comprises a series of reinforcing structures and baffles (partially visible in FIG. 2) in addition to the plurality of sealed and/or sealable internal chambers. The configuration of reinforcing structures, sealed and/or sealable internal chambers may vary depending on the weight and configuration of the platform, the weight and configuration of the payload being deployed, the buoyancy requirements for launch and recovery, and the like.

Different internal areas may be partitioned to provide different numbers, configurations and volumes of internal buoyancy chambers. In some embodiments, one or more sealed or sealable buoyancy chambers may be provided as dedicated buoyancy chambers (i.e. they remain entirely or partially gas-filled when the platform is submerged), while one or more sealable chambers may be provided as selectable buoyancy chambers to which gas or water is introduced, under the control of a user or using an automated control system, during launch (submersion) and recovery (re-surfacing) protocols. Dedicated and selectable buoyancy chambers may be sized and configured to provide a net negative buoyancy of the platform that's relatively small relative to the mass of the platform (and payload), and may be positioned to provide a stable center and distribution of platform (and payload) mass.

In the system illustrated in FIGS. 1 and 2, one or more compressed gas storage tanks, or one or more sets of compressed gas storage tanks, such as a tank sets 103A, 103B, with associated fittings, hoses and valves, is provided for introducing gas to one or more sealable chamber(s) and thereby increasing platform buoyancy to raise the platform from depth during a recovery protocol. In some embodiments, one or more compressed gas storage tanks are located at or above the center of mass of the platform, such as on the platform deck, as shown. In some embodiments, one or more compressed gas storage tanks are located below the center of mass of the platform, such as within the internal volume of the platform. In some embodiments, one or more compressed gas storage tanks may be located both above and below the center of mass of the platform. In some embodiments, compressed gas tanks are low pressure tanks, storing gas (e.g., air) at pressures of less than about 300 psi. In some embodiments, gas (e.g., air) is stored in compressed gas tanks at pressures of less than about 200 psi. In some embodiments, both low pressure and higher pressure gas storage tanks are provided. In some embodiments, one or more higher pressure gas storage tanks may be provided and may feed into one or more low pressure gas storage tanks.

One or more gas storage tank(s) (e.g., a set of three or more, as shown) may be stably mounted on a pallet 104 or another mounting structure that may easily be secured to and removed from the platform deck as a unit. Different gas storage tank and pallet configurations may be used depending on the payload, the platform configuration, and the launch and retrieval protocol, and the gas storage pallets may be arranged differently on the platform, also depending on the payload, the platform configuration, and the launch and retrieval protocol. Because low pressure gas storage tanks are used, the tank weight is relatively low, and the tanks may displace more water than they weigh, making them positively buoyant. In addition, when low pressure tanks are used, the associated fittings, hoses and valves may have a relatively large diameter, providing rapid tank fill and evacuation times. Low pressure gas tanks are fillable using commonly available low pressure sources, such as conventional compressed air sources.

The size, configuration and placement of sealable buoyancy chambers provided underneath the platform deck may be chosen depending on a variety of factors, as mentioned above. In the embodiments illustrated in FIGS. 1 and 2 (which illustrate one half of a preferred platform structure), platform 100 employs four sets of tanks, one set located in each quadrant of the platform. In some embodiments, each tank set and its fittings, hoses and valves may be associated with a discrete sealable buoyancy chamber positioned substantially below the deck. In some embodiments, multiple tank sets and fittings may be associated with common sealable buoyancy chambers.

In the illustrated embodiment, a sealable buoyancy chamber is located in each quadrant of the platform, e.g., forward port and starboard quadrants and aft port and starboard quadrants. Forward port and aft port buoyancy chambers 105A, 105B, respectively, are visible in FIG. 2. Each of the buoyancy chambers has an associated valve system for releasing gas from and introducing water to the chamber (during a platform submersion protocol), and an associated valve system for introducing air to and discharging water from the chamber (during a platform recovery protocol). In the embodiment illustrated in FIG. 2, each sealable buoyancy chamber 105A, 105B is L-shaped, with a longer leg portion positioned along an outboard side of the platform and a shorter leg portion positioned along an outboard aft or bow side of the platform. Each of these chambers may be associated with a dedicated tank set (103A, 103B), as illustrated. In alternative embodiments, a single tank set may be associated with two or more chambers. The tank sets may be located at an outboard location on the deck, as shown, near the associated buoyancy chamber.

FIGS. 1 and 2 additionally illustrate (optional) platform stabilizers provided as pivoting arms 106A, 106B positionable in an on-deck, undeployed condition (106B) and a deployed condition (106A) in which they extend below the platform hull. Pivoting arms 106A, 106B may be fully or partially deployed to provide additional mass and stability to the platform (with or without a payload). A plurality of platform stabilizers may be positioned in a symmetrical relationship, such as at corners of a platform, and configured to extend below the center of mass of the platform when it is submerged.

In some embodiments, the submersible platform may have single or multiple hulls that reduce the drag of the platform as it moves over or through the water. In some embodiments, the submersible platform may be designed and operated as a towed vessel or transported as cargo to locate it at a desired dive site; in other embodiments, the submersible platform may incorporate a propulsion system (and, optionally, a steering system) that assists, or independently propels the platform to a desired site. When the submersible platform is provided as (or as part of) an independently operable vessel, it may be controlled by an on-board operator, or it may optionally be controlled, at least in part, using remotely controlled operating systems. Suitable navigation, locational, operating and safety features, which are well known in the art, may be provided as part of or in conjunction with the submersible platform.

In the embodiment illustrated in FIG. 2, a submersible vehicle 120 is shown docked on the platform deck and is the payload to be submerged (for launch) and then delivered to the surface (for recovery). In some embodiments, the mass of the platform is at least as great as the mass of the payload. In some embodiments, the platform has a net negative buoyancy that is relatively small compared to the mass of the platform. In some embodiments, the net negative buoyancy of the of the platform is less than about 10% of the total platform mass; in some embodiments, the net negative buoyancy of the of the platform is less than about 5% of the total platform mass; in yet other embodiments, the net negative buoyancy of the platform is less than about 1% of the total platform mass. In some embodiments, the mass of the platform is high compared to the mass of the payload. In some embodiments, for example, the mass of the platform is at least as great as the mass of the payload; in some embodiments the mass of the platform is greater than the mass of the payload; in some embodiments, the mass of the platform is at least about 1.2 to 3 times the mass of the payload.

In operation, a platform and an associated payload may be located at a desired deployment site, e.g. by self-propulsion, or by being towed in a floating, submerged or partially submerged condition, or by delivery on-board a vessel, or by other delivery methods. If the platform is floating at the deployment site, the buoyancy chambers may be opened, under the control of an operator, to flood or partially flood one or more buoyancy chambers and to controllably submerge the platform and its payload at the desired deployment site. In one embodiment, a platform (and payload) launch protocol provides for flooding of aft and forward buoyancy chambers using a different timing protocol and/or discharge rate, resulting in positioning and controlled submersion of the platform (and payload) at an angle to the sea surface. In one embodiment, for example, aft (or forward) buoyancy chambers may be flooded prior to and/or at a higher rate than forward (or aft) buoyancy chambers, resulting in tilting of the platform (and payload) along a fore/aft axis at an angle of from about 3° to about 45° to the sea surface during deployment. In some deployment protocols, the buoyancy chamber flood protocols may be adjusted to provide a platform tilt angle of from about 10° to 30° along a fore/aft axis during submersion. The platform, when submerged to a desired depth, may be leveled, if desired, prior to, during or following deployment of the payload by additional flooding of selected buoyancy chamber(s).

The payload may be released from the platform while submerged, and the platform may be maintained in a submerged condition at the deployment site, awaiting recovery of the payload, using floats, as described below. Recovery of the platform (and payload) may proceed, under the control of an operator, as the reverse of the procedure described above. The platform may, as a result of differential buoyancy chamber fill rates and/or timing, be brought to the sea surface in a tilted condition using a protocol that may be substantially similar to that used for deployment, and then leveled at the surface.

In some embodiments, the one or more buoyant or floatable elements (referred to as buoyant members or floats) may be mounted or mountable to lines/cables/chains (referred to, collectively, as "cables") anchored to the submersible platform. These lines/cables/chains may include springs to further dampen effects of surface waves and disturbances. In some embodiments, for example, mechanical springs may be associated with the cables. In some embodiments, cables may include coiled spring portions having a low spring constant or other types of elastic elements. In some embodiments, mechanical devices such as snubbers may be used in combination with cables to provide a spring or elastic effect.

In one embodiment, one or more buoyant member(s) are releasably mounted to the platform under the control of a remotely operable release mechanism, such that a remote operator may selectively release one or more buoyant member(s) from an anchored condition on the platform prior to or during submersion of the platform, allowing the buoyant member(s) to remain on the surface during submersion of the platform. An appropriate length of coupling mechanisms (e.g., cables) may be released or paid out manually or automatically, such as via a remotely controlled system.

The platform or an assist vessel may carry different configurations or types of buoyant members designed for use in different sea conditions, and different floats may be mounted to the submersible platform prior to deployment based on the mass of the platform and payload, the salinity of the water at the dive site, current and/or anticipated sea conditions, and the like. In general, one or more buoyant members may comprise conventional inflatable cylindrical buoys, sealed pipes or other enclosed structures filled with a gas or with a lightweight foam material, or the like. Variable buoyancy floats may also be provided, such as enclosed structures that have an adjustment feature providing variable buoyancy of the structures.

The submersible platform may be towed or shipped or otherwise maneuvered (e.g., under its own power) to a desired dive or payload launch site. The payload, which may include a manned or autonomous submersible vehicle or another type of submersible craft, a robotic vehicle or piece of equipment, another type of equipment or vehicle or platform for placement in a subsea location, may be mounted on the submersible platform prior to transit to the desired launch site and conveyed to the launch site on the submersible platform, or it may be mounted on the platform at the launch site. In an alternative operating scenario, the payload may be anchored to the submersible platform prior to a launch operation and the combination platform/payload may be submerged to a desired depth and towed to a desired launch site in a submerged or partially submerged condition. The payload is generally supported by the submersible platform during its descent from the sea surface to a subsurface location and may be releasably connected to the submersible platform, for example under the control of a remotely operable release mechanism.

In one scenario, the payload is releasable locked in position on the submersible platform, which is then located at a launch site as described above. The platform, with the payload attached, is submerged using a controlled buoyancy system (as described above) to a desired depth. One or more buoyant floats is released from the platform as the platform is submerged, and the float(s) remain at or near the sea surface, tethered to the submerged platform by a coupling mechanism (e.g., cables). The comparatively large mass and dampening of the platform in the subsea location counteract and overcome the sea surface and spring/float disturbances to maintain a stable submerged platform/payload condition. The payload may be released from the platform (e.g., manually by a diver or via remote control without requiring a diver) when the platform reaches a desired depth. Following payload release, the platform may be returned to the surface or remain submerged, awaiting a recovery operation. Recovery may be carried out as the reverse of the launch operation.

Figure 3:
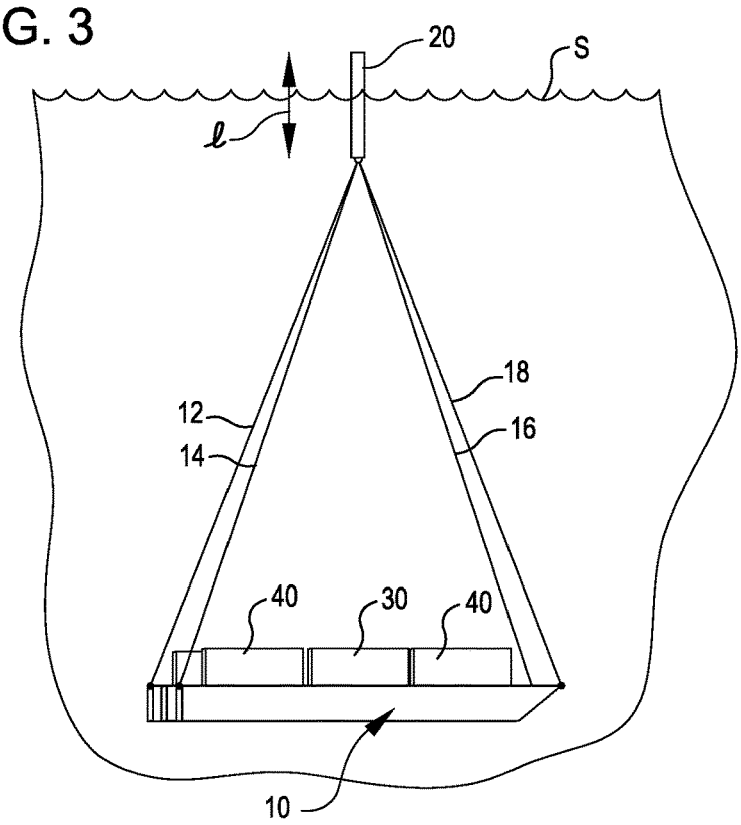
FIG. 3 shows a schematic drawing illustrating a platform in a submerged condition below a sea surface with a single buoyant element coupled to the platform providing platform depth maintenance.

FIG. 3 schematically illustrates a platform 10 in a submerged and supported condition below sea surface S, with a single buoyant element depicted as float 20 coupled to the submerged platform by means of a plurality of cables/lines/chains or equivalent supporting structures 12, 14, 16, 18, referred to collectively as "cables." Platform 10 is both floatable and submersible, under the control of a user. Internal platform chambers may be flooded to submerge the platform, and one or more ballast reservoirs 40 (such as one or more compressed gas storage tanks), shown schematically, may be provided on or within platform 10 to provide controlled floatation of the platform and its payload following submersion to a desired subsea depth. In some embodiments, ballast reservoirs 40 store gas at low pressures and are remotely controllable at the site of the platform or from another vessel or location. Payload 30 is typically positioned on or within platform 10, and may be anchored to the platform during launch and recovery. Payload 30 may comprise one or more submersible vehicles, various types of equipment, or the like, and for delivery to, storage at, and/or recovery from an underwater location using systems and methods disclosed herein.

Float 20 shown in the illustrative embodiment of FIG. 3 preferably has sufficient buoyancy to support platform 10 and its payload 30 at a desired depth in a submerged condition and acts as a "spring" float in the platform/float system. Float 20 generally has a small surface area and/or footprint in comparison to the surface area and/or footprint of platform 10. In some embodiments, the surface area of float 20 is less than 50% the surface area of platform 10; in some embodiments, the surface area of float 20 is less than 25% the surface area of platform 10; in some embodiments, the surface area of float 20 is less than 10% the surface area of platform 10; in yet other embodiments, the surface area of float 20 is less than 5%, or less than 1%, the surface area of platform 10. In some embodiments, the footprint of float 20 is less than 50% the surface area of platform 10; in some embodiments, the footprint of float 20 is less than 25% the surface area of platform 10; in some embodiments, the footprint of float 20 is less than 10% the surface area of platform 10; in yet other embodiments, the footprint of float 20 is less than 5%, or less than 1%, the surface area of platform 10.

In one embodiment of a system as disclosed herein, the length (l) of float 20, oriented generally orthogonal to the sea surface when platform 10 is submerged (as shown in FIG. 3), is greater than the largest cross-sectional dimension of float 20. In some embodiments, the ratio of the length (l) of float 20 to its largest cross-sectional diameter is at least about 2:1; in some embodiments the ratio of the length (l) of float 20 to its largest cross-sectional diameter is at least about 5:1; in yet other embodiments, the ratio of the length (l) of float 20 to its largest cross-sectional diameter is more than about 5:1 and at least about 8:1. Float 20 may have a generally cylindrical, oval, rectangular or polygonal cross-sectional configuration. Float 20, illustrated in FIG. 3, has a substantially cylindrical configuration, with a uniform cross-sectional configuration and size over its length. In alternative embodiments, float 20 may have different cross-sectional configurations or cross-sectional surface areas over its length.

Coupling cables 12, 14, 16, 18 are generally mounted to a lower portion of buoyant element 20 and coupled to the submersible platform 10 at two or more locations in a balanced, symmetrical arrangement to aid in supporting the platform in a stable, level condition during submersion of the platform, maintenance of the platform at depth, deployment of the payload, recovery and surfacing of the platform. Providing four (4) cables, with one attached near each corner of a rectangular platform 10, is illustrated in FIG. 3 and provides good stability and a balanced arrangement. It will be appreciated that alternative arrangements and cable anchoring positions may be implemented. In another embodiment, for example, when the platform 10 is generally rectangular, cables may be mounted at or near the midpoint of each side of the platform. Cables are generally flexible along their length and capable of supporting the platform and any associated payload at desired depths.

In some embodiments, the platform and payload are suspended in a neutral to slightly negative buoyancy condition when submerged, with the buoyant members supporting the platform and payload in a slightly negative buoyancy condition. Variable conditions at desired dive sites, such as salinity, sea surface conditions, turbulence, wave height and frequency, and the like may be taken into consideration in matching a float system comprising one or more floats to support a desired platform and payload combination at a desired depth in a desired neutral to slightly negative buoyancy condition.

Figure 4:
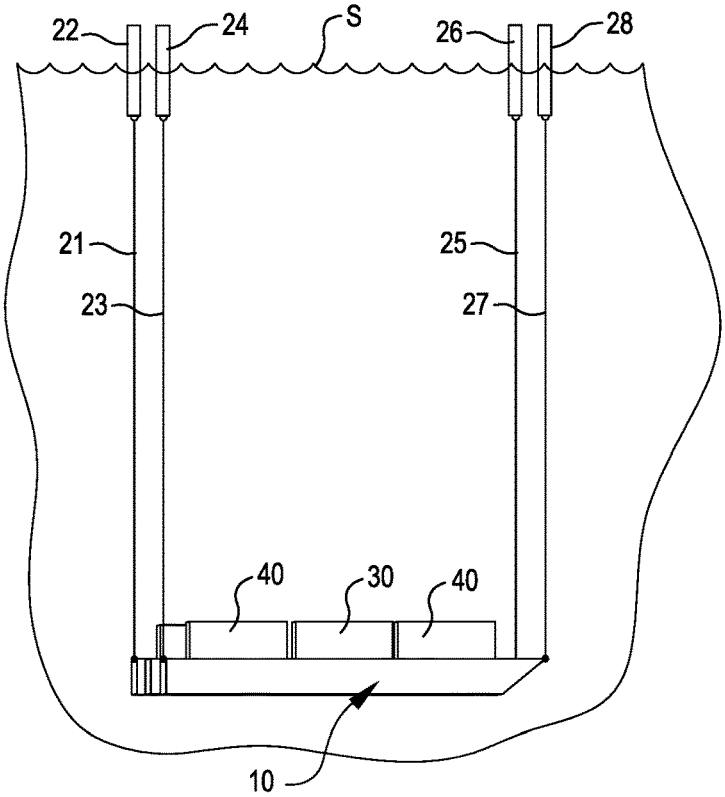
FIG. 4 shows a schematic drawing illustrating a platform in a submerged condition below a sea surface with multiple buoyant elements coupled to the platform providing platform depth maintenance.

In some embodiments, the platform and payload is suspended by multiple spring floats coupled to the platform by coupling mechanisms. One example of this type of system is illustrated schematically in FIG. 4. In this example, platform 10 is supported in a submerged condition by multiple buoyant members 22, 24, 26 and 28. Cables 21, 23, 25, 27 anchor floats 22, 24, 26 and 28 to the platform independently of one another, which may reduce the risk of entanglement with the payload when the payload is released at or returned to the platform at depth. In alternative embodiments, the coupling mechanisms and/or multiple floats may be loosely coupled to one another. In the exemplary embodiment illustrated in FIG. 4, four floats are provided, and each is coupled to the submersible platform in proximity to a corner of the platform. Additional floats and coupling mechanisms may be provided in yet alternative embodiments.

Figure 5:
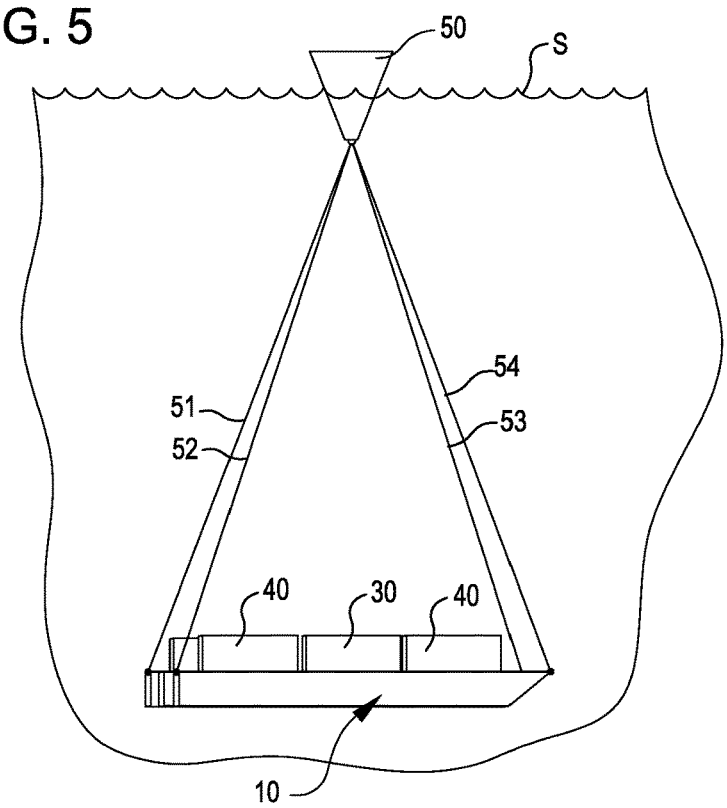
FIG. 5 shows a schematic drawing illustrating a platform in a submerged condition below a sea surface with a single buoyant element having an inverted conical configuration coupled to the platform providing platform depth maintenance.

Another exemplary embodiment of a similarly submerged and suspended work platform 10 is shown in FIG. 5. This system is similar to the system described above and includes a float 50 having a generally conical configuration. Conical float 50 may be positioned and oriented with the larger cross-sectional and/or surface area portion of the float in an upper position (as shown in FIG. 5) above or nearer to the sea surface, with the smaller cross-section and/or surface area portion of the float in a downward-oriented arrangement, at or below the sea surface. A plurality of coupling mechanisms (e.g., cables 51, 52, 53, 54) may be provided to couple float 50 to the platform 10. The coupling mechanisms may be mounted to the lower portion of the float, as shown. The use of a float having a configuration in which a larger surface area is positioned above the sea surface and a smaller surface area is positioned below the sea surface when a platform and payload is submerged may provide a dampening moment with more precise depth control of the system.

Figure 6:
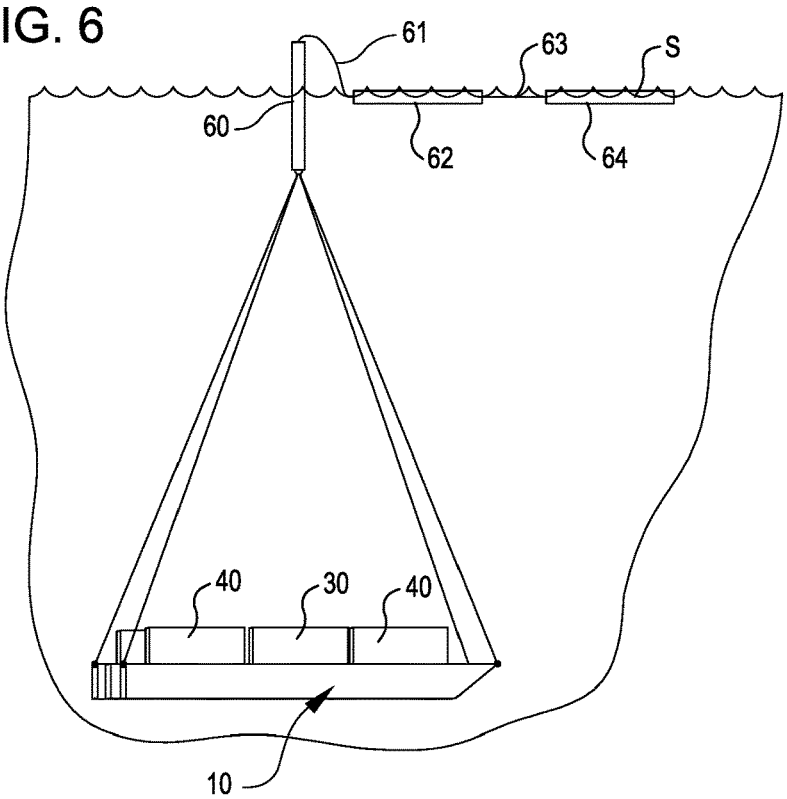
FIG. 6 shows a schematic drawing illustrating a platform in a submerged condition below a sea surface with multiple buoyant elements coupled to the platform providing platform depth maintenance.

In yet another embodiment, multiple spring floats may be coupled to one another to provide a desired buoyancy and may provide flexibility for slightly varying net negative buoyancy of the platform and payload. In circumstances where the desired spring constant is low and the net negative buoyancy of the load is not precisely determinable, this arrangement provides a known spring force without requiring an overly long or top-heavy spring float. One example of a system of this type is illustrated schematically in FIG. 6. In this embodiment, a first buoyant element 60 is coupled to additional buoyant elements 62, 64 by means of connecting elements 61, 63, such as cables or lines. Buoyant elements may be configured and arranged to provide buoyancy in different orientations and may be provided in different configurations than those shown. In the embodiment illustrated, float 60 is oriented in a substantially vertical orientation while supporting a submerged platform, while floats 62 and 64 are oriented in substantially horizontal orientations. In this system, the buoyant members have a buoyancy that supports them and the submerged platform and payload in a stable location below the sea surface during deployment or recovery of the platform in a subsea location.

Figure 7:
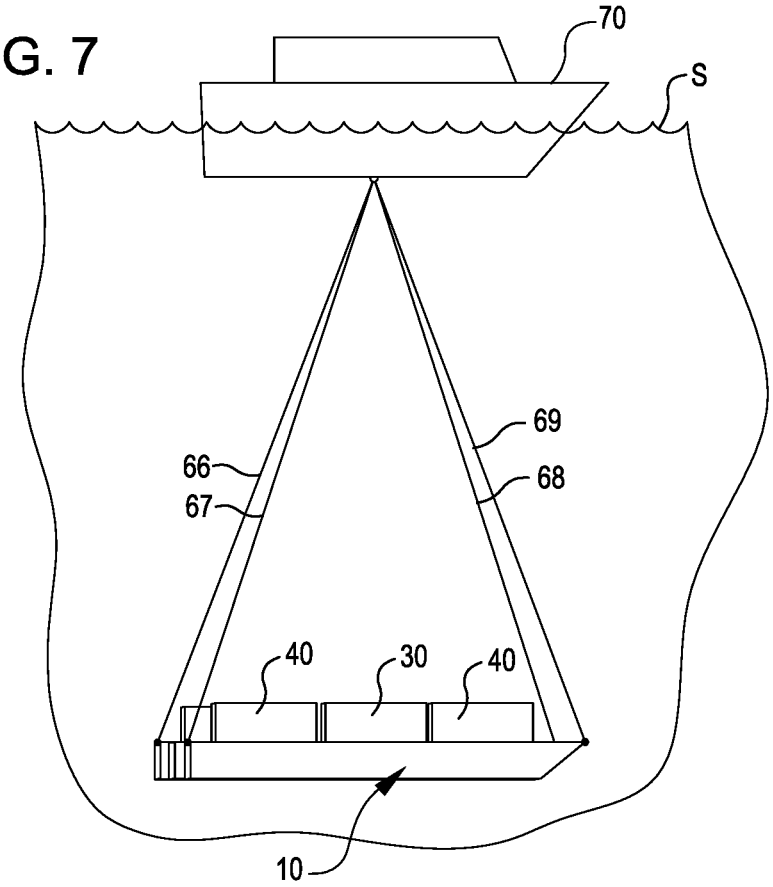
FIG. 7 shows a schematic drawing illustrating a platform in a submerged condition below a sea surface and tethered to a floating vessel to provide platform depth maintenance.

FIG. 7 illustrates yet another embodiment in which a vessel 70 serves as a buoyant element or float supporting submerged platform 10 via cables 66, 67, 68, 69. Cables 66, 67, 68, 69 may comprise elastic or resilient element(s) such as spring(s), elastic or resilient cable(s), or the like. In this embodiment, platform 10 may be tethered to vessel 70 for towing to a desired deployment site and then submerged to a desired depth at the site while remaining coupled to the vessel by means of the resilient cables or springs. While the mounting location for cables on vessel 70 is illustrated on a submerged central portion of the vessel, it will be appreciated that alternative mounting point locations and additional mounting points may be employed. In some embodiments, for example, resilient cables 66, 67, 68, 69 may be tethered to attachment points provided at vessel hull or deck locations.

In some embodiments, the float(s) or vessel may act as passive spring elements in the spring mass dampener system where the submersible platform serves as a large mass dampener. In alternative embodiments, the float or vessel may be supplemented by an active control system that is capable of detecting sea surface changes and automatically feeds out and takes in the coupling mechanism (line, chain, cable, etc.) as the float or vessel encounters sea surface disturbances. An inertial reel, an electric or hydraulic motor may be used as an active float positioning control mechanism. In general, no active platform buoyancy or other active depth control system requiring monitoring or adjustment of platform chamber fill volumes or gas introduction is required to support the submersible platform in the submerged condition as a result of the deployment of one or more coupled float(s)/vessel at or near the sea surface. In some embodiments, however, it may be desirable to incorporate an active platform buoyancy or another active depth control system.

FIGS. 8-12 illustrate a payload docking system providing secure docking of the payload on a platform and convenient release of the payload from the platform. The payload illustrated in FIGS. 8-12 is a submersible vehicle 120 (shown in part) having a rail 122 mounted to a framework 124 extending from the vehicle. A complementary channel 130 is mounted (directly or indirectly) on the deck of the platform. One end of rail 122 (a forward end, as illustrated) may be provided with a hook 126 or a detent or latching system (mechanical, magnetic, etc.), and a complementary attachment mechanism, such as latching bracket 132 is located at a desired position on channel 130. Note that while the docking system illustrated in FIGS. 8-12 may comprise a stand-alone docking system, they represent one half of a platform and docking system according to alternative embodiments. In embodiments that involve at least two rails extending from the vehicle, two complementary channels are mounted on the deck of the platform. In these embodiments, FIGS. 8-12 show a left-hand side of the platform and payload docking system and a second platform portion with a second rail, channel and latching system may be provided, in a mirror image, on the right-hand side of the payload and platform.

In accordance with the docking system illustrated in FIGS. 8-12, rail(s) 122 extending from the payload are positioned in complementary channel(s) 130 mounted on the platform deck and the payload is guided, by sliding the rail(s) along the channel(s), toward the latching system until the latching system (illustrated as a hook and bracket) is latched. In some embodiments, a single rail and channel docking system may be employed; in alternative embodiments, at least two rails and complementary channels are employed. When multiple rails and complementary channels are used, they may be arranged in a substantially parallel relationship to one another, or they may be arranged in a non-parallel, angular relationship to one another.

In the illustrated embodiment, a channel portion 134 is located at some distance from latching bracket 132 and is raised or tiltable in relation to channel 130. This arrangement allows the payload rail(s) that engage channel portion 134 to steer the payload at a slight angle toward latching bracket 132 to facilitate latching. In some embodiments, providing a single latching bracket for securing each rail to each channel (and thereby the platform) is sufficient. In some embodiments, rail 122 may have a second latching element 128, such as a smaller perimeter extension member, located in proximity to the other terminal end of the rail (e.g., an aft end), as shown. The second latching member 128 may be securely mated with a mating latching member or another element provided on the channel system, or by seating in a cavity provided between the channels.

Figure 8:
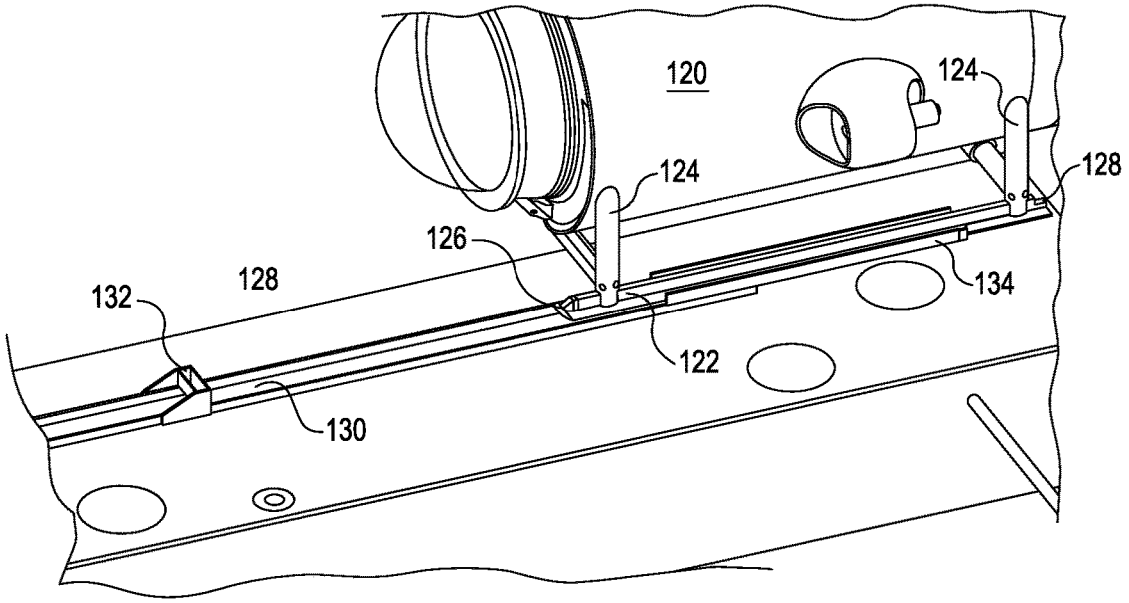
FIGS. 8-12 show drawings illustrating one system and sequence for securely docking a payload, such as a submersible vehicle, on the deck of a submersible platform.
Figure 9:
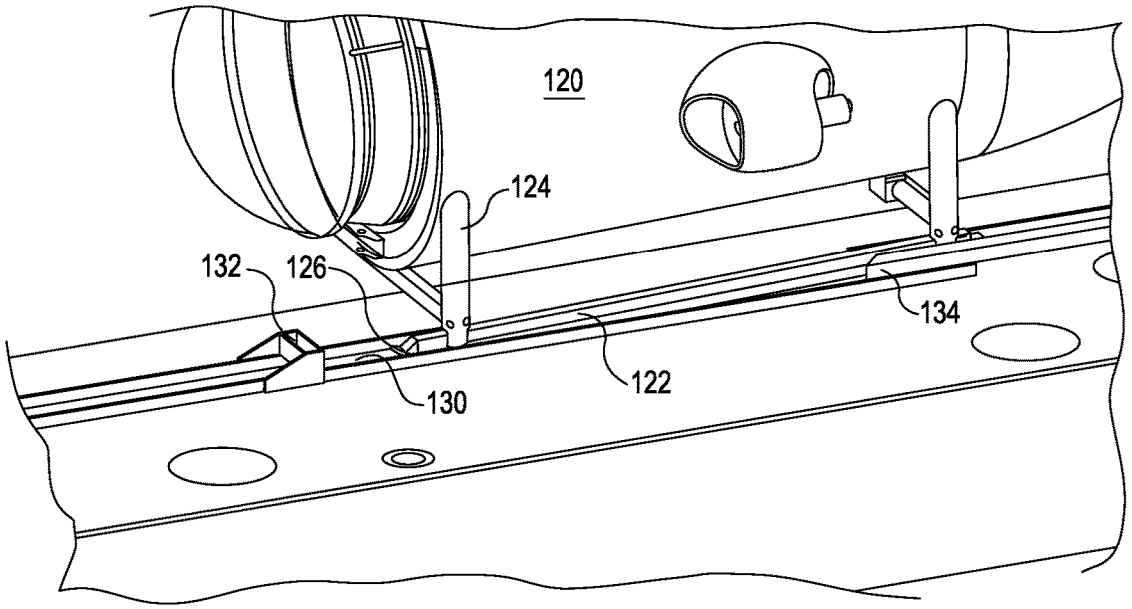
Figure 10:
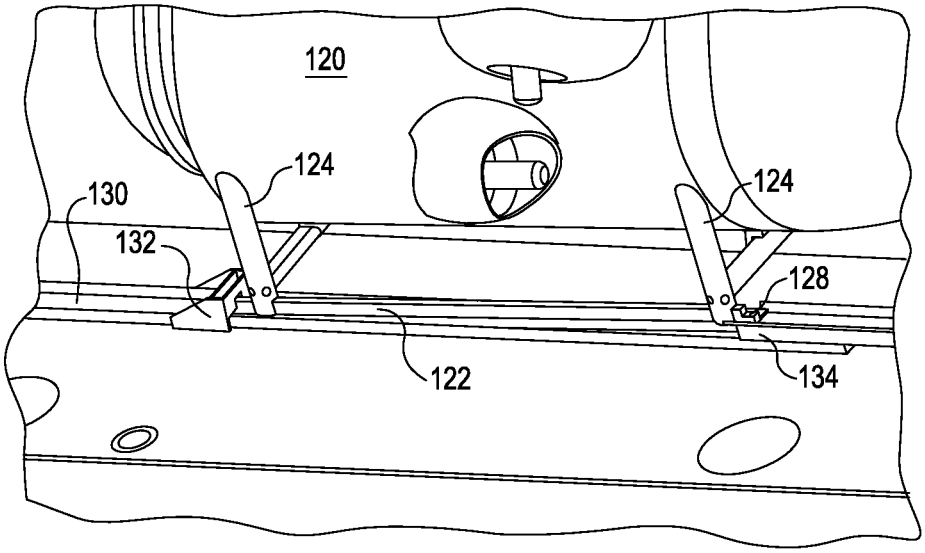
Figure 11:
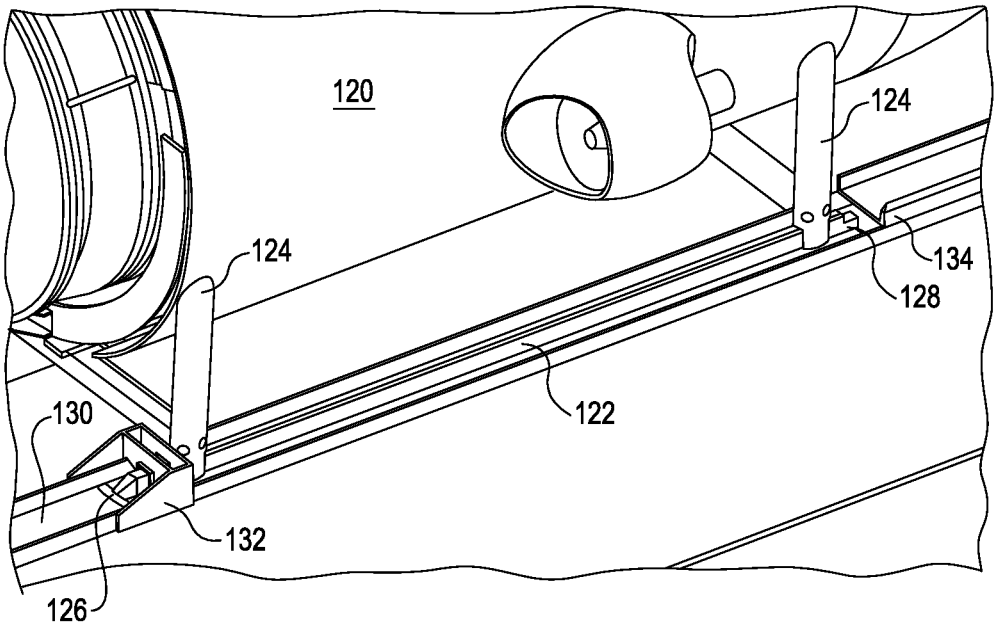
Figure 12:
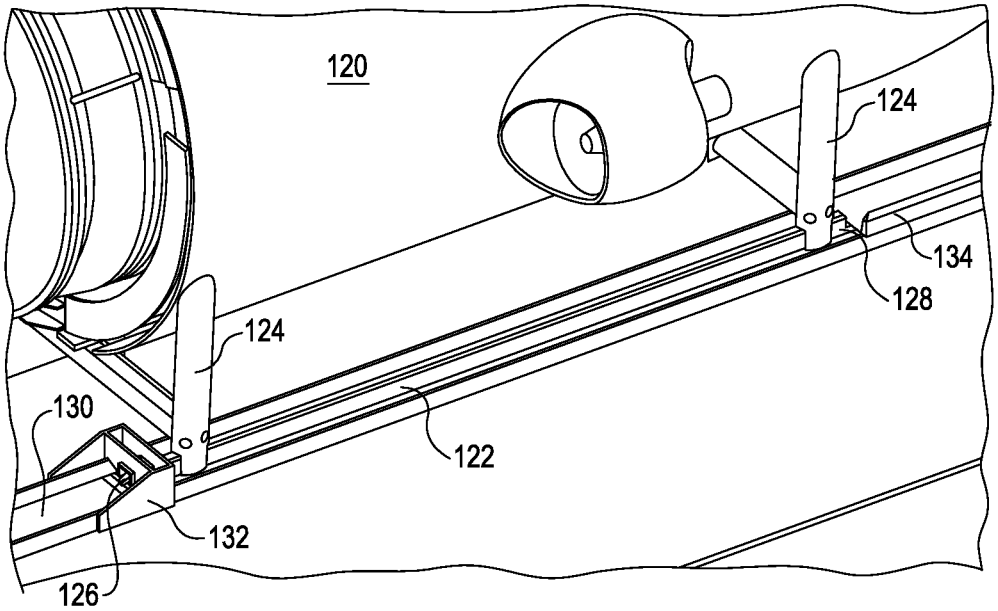

FIG. 8 shows the port payload rail 122 aligning on the aft (elevated) channel 134; FIG. 9 shows the payload 120 and payload rail 122 sliding forward with the aid of the elevated and tiltable channel 134 and rocking downwardly into forward guide channel 130; FIG. 10 shows the forward latch member (hook) 126 latching in the forward rail bracket 132 to secure the rail 122 and payload 120 laterally and vertically at the forward end. FIG. 11 shows the aft portion of the rail 122 and the aft latch member 128 dropping down and seating in channel 130; and FIG. 12 shows repositioning of the rail 122 and payload 120 to seat the aft latching member(s) 128 underneath raised channel 134, securing the rail and payload laterally and vertically at the aft end. While a single rail/channel embodiment of this docking system and protocol is illustrated in the figures for purposes of clarity, it will be appreciated that docking systems employing two or more rails associated with a payload and two or more complementary channels associated with a platform, with one or more latching point provided for each rail and channel combination may be employed.

It will be appreciated that many different types of docking and release systems may be implemented, depending on the size, mass and weight distribution of the payload, the arrangement of payload elements on a platform deck, and the like. Providing a payload docking system that secures the payload laterally and vertically on the platform deck and that is remotely operable is preferred in many embodiments.

In the description provided above, the term "about" means+/−20% of the indicated value or range unless otherwise indicated. The terms "a" and "an," as used herein, refer to one or more of the enumerated components or items. The use of alternative language (e.g., "or") will be understood to mean either one, both or any combination of the alternatives, unless otherwise expressly indicated. The terms "include" and "comprise" are used interchangeably and both of those terms, and variants thereof, are intended to be construed as being non-limiting.

It will be appreciated that the methods and systems of the present invention may be embodied in a variety of different forms, and that the specific embodiments shown in the figures and described herein are presented with the understanding that the present disclosure is considered exemplary of the principles of the invention, and is not intended to limit any claimed subject matter to the illustrations and description provided herein. The various embodiments described may be combined to provide further embodiments. The described devices, systems, methods and compositions may omit some elements or steps, add other elements or steps, or combine the elements or execute steps in a different combination or order than that specifically described.

I claim:

1. A submersible platform comprising a deck and a payload docking system providing secure docking of the payload on the deck and release of the payload from the deck, wherein the payload docking system has at least one of a channel or a rail mounted to the deck configured for mating with at least one of a complementary channel or rail mounted on a payload and at least one attachment mechanism configured for mating with a complementary latching mechanism associated with the payload, wherein a portion of the channel or rail mounted to the deck is raised or tiltable in relation to the deck, whereby upon mating of a complementary rail or channel, the payload is oriented at an angle.

2. A method for docking an object on a deck of a submerged platform, comprising: positioning a rail or channel mounted to an object in a mating channel or rail mounted to a deck of the submerged platform; guiding the rail along the channel; and interfacing a first latching element positioned in proximity to an end of the rail with a mating second latching element positioned on the channel, thereby mating the first and second latching elements to secure the payload laterally and vertically on the deck, wherein the method additionally comprising a third rail latching element positioned aft of the forward area of the rail and a fourth channel latching element positioned aft of the forward area of the channel.

3. A method for docking an object on a deck of a submerged platform, comprising: positioning a rail or channel mounted to an object in a mating channel or rail mounted to a deck of the submerged platform; guiding the rail along the channel; and interfacing a first latching element positioned in proximity to an end of the rail with a mating second latching element positioned on the channel, thereby mating the first and second latching elements to secure the payload laterally and vertically on the deck, wherein at least a portion of the channel is tilted or tiltable relative to the deck.

4. A method for docking an object on a deck of a submerged platform, comprising: positioning a rail or channel mounted to an object in a mating channel or rail mounted to a deck of the submerged platform; guiding the rail along the channel; and interfacing a first latching element positioned in proximity to an end of the rail with a mating second latching element positioned on the channel, thereby mating the first and second latching elements to secure the payload laterally and vertically on the deck, wherein a first and second channel portion are mounted on a common longitudinal path, and wherein at least one of the channel portions is tilted or tiltable relative to the other channel portion.

* * * * *